US005127468A

United States Patent [19]

Poulsen

[11] Patent Number: 5,127,468

[45] Date of Patent: Jul. 7, 1992

[54] METHOD AND ASSEMBLY FOR CONSUMABLE ELECTRODE VACUUM ARC MELTING

[75] Inventor: Eldon R. Poulsen, Las Vegas, Nev.

[73] Assignee: Titanium Metals Corporation, Pittsburgh, Pa.

[21] Appl. No.: 653,964

[22] Filed: Feb. 12, 1991

[51] Int. Cl.[5] ..... B22D 27/02

[52] U.S. Cl. ..... 164/495; 164/508; 373/88

[58] Field of Search ..... 164/495, 496, 508, 509, 164/469, 470, 497; 373/88, 94

[56] References Cited

U.S. PATENT DOCUMENTS 3,516,476 6/1970 Scriver ..... 164/495

*Primary Examiner*—Kuang Y. Lin

*Attorney, Agent, or Firm*—Finnegan, Henderson, Farabow, Garrett & Dunner

[57] ABSTRACT

A method and electrode assembly for use in consumable electrode arc melting of metals and alloys, particularly titanium and titanium-base alloys. The method includes forming an assembly including an electrode of the metal or alloy to be melted. An elongated ring, which is of metal or alloy construction, has one end connected to one end surface of the electrode and another end connected to an electrode holder, which is connected to a source of electrical potential. The ring has an outside diameter less than the outside diameter of the electrode to form an annular marginal area on the end surface of the electrode. This annular marginal area is defined by the ring and the periphery of the end surface of the electrode. This assembly is positioned within a cooled mold of conductive material, which mold is also connected to a source of electrical potential. An electrical current is produced between the electrode and the mold to produce an arc from the end of the electrode to continuously melt the electrode to form an ingot. Melting is continued until the annular marginal area at least begins to melt and melting is discontinued before the marginal area melts completely away. Hence, the melting operation may be stopped before the electrode is completely melted away to result in contamination of the ingot by melting of material from the ring or electrode holder.

3 Claims, 1 Drawing Sheet

METHOD AND ASSEMBLY FOR CONSUMABLE ELECTRODE VACUUM ARC MELTING

BACKGROUND OF THE INVENTION

1. Field of the Invention

The invention relates to a method and an electrode assembly for the consumable electrode vacuum arc melting of metals and alloys, particularly reactive metals and alloys of titanium.

2. Description of the Prior Art

In the production of metals and alloys, and particularly reactive metals and alloys of titanium, it is known to produce the same by consumable electrode, vacuum arc melting.

In this practice an electrode is made of the material to be melted and refined. The electrode is placed in a water cooled, evacuated mold and electric current is passed through the electrode and mold to create an arc between the electrode and the mold to produce progressive melting away of the electrode material into the mold. During this operation the mold is continuously evacuated to remove the impurities released as gaseous reaction products during the melting operation. As the electrode is melted it progressively solidifies in the mold to form a solidified ingot therein.

As the melting of the electrode nears completion, it is conventional practice to leave a portion of the electrode unmelted. Otherwise, melting of the electrode holder and thus contamination of the alloy of the ingot may result. This unmelted material is then recycled for further electrode production and subsequent melting. This results in a significant production cost increase resulting from the required remelting. For example, in a conventional triple-vacuum arc melting operation of a conventional alloy of Ti-6 Al-4V alloy, the unmelted electrode portion from the second and final melt will typically weigh 300 to 500 pounds each, thus resulting in a recycled material weight of 600 to 100 pounds.

SUMMARY OF THE INVENTION

It is accordingly a primary object of the present invention to provide a practice for accurately determining the end of the melt during a consumable electrode, vacuum arc melting operation to in turn reduce the amount of unmelted material required to be recycled.

A more specific object of the invention is to provide a method for consumable electrode vacuum arc melting wherein a visual indication of the electrode may be obtained to indicate the end of melting.

In accordance with the method of the invention for consumable electrode vacuum arc melting of metals and alloys, an assembly is formed of an electrode of the metal or alloy to be melted. An elongated ring, which is of metal or alloy construction, has one end thereof connected to one end surface of the electrode and another end connected to an electrode holder, which is connected to a source of electrical potential. The ring has an outside diameter less than the outside diameter of the electrode to form an annular marginal area on the end surface of the electrode. This annular marginal area is defined by the ring and the periphery of the end surface of the electrode. This assembly is positioned within a cooled mold of conductive material, which mold is also connected to a source of electrical potential. An electrical current is produced between the electrode and the mold to produce an arc from the end of the electrode to continuously melt the metal or alloy from the electrode and into the mold to progressively solidify the same to form an ingot. The mold is evacuated during the melting operation, so as to remove the gaseous reaction products from the mold. Melting is continued until the annular marginal area at least begins to melt and melting is discontinued before the marginal area melts completely away. In this manner the melting may be stopped before the electrode is completely melted away to result in contamination of the ingot by melting of material from the ring or electrode holder. The melting away of the marginal area of the electrode may be readily observed during the end of the melting operation.

Preferably the annular marginal area on the end surface of the electrode has a width of at least four inches, and preferably the electrode diameter is within the range of 23 to 29 inches.

In accordance with the electrode assembly of the invention for use in consumable electrode arc melting of metals and alloys, the assembly has an electrode of the metal or alloy to be melted, and an elongated ring having an end connected to an end surface of the electrode with the other end of the elongated ring connected to an electrode holder. The ring has an outside diameter less than an outside diameter of the electrode to form an annular marginal area on the end surface of the electrode, which marginal area is defined by the ring and the periphery of the end surface of the electrode.

Preferably the annular marginal area on the end surface of the electrode has a width of at least four inches, and the electrode has a diameter within the range of 23 to 29 inches.

DESCRIPTION OF THE PREFERRED EMBODIMENT

Figure 1:
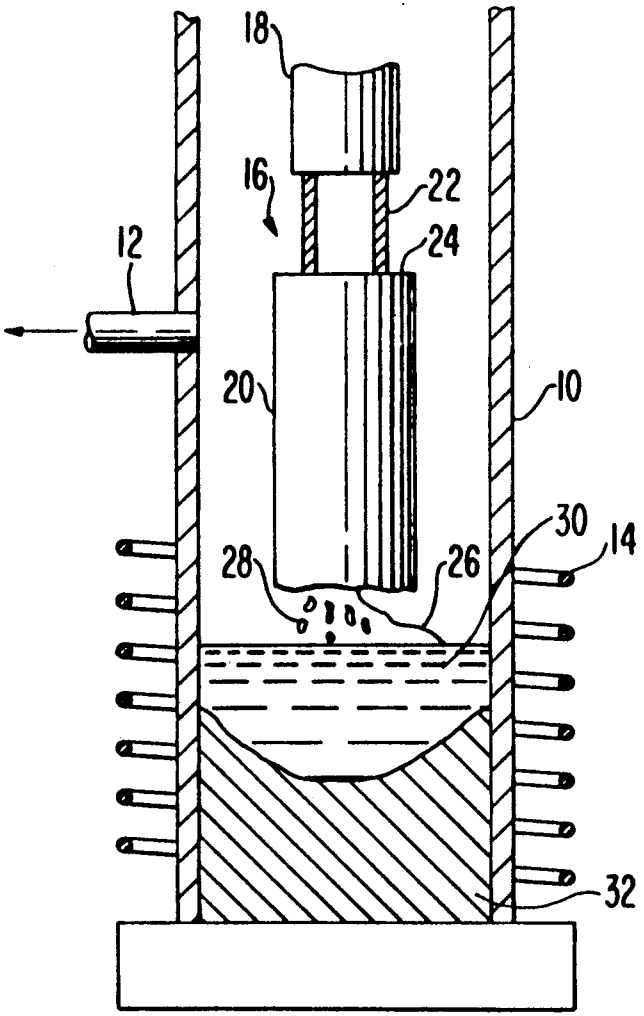
FIG. 1 is an elevational view in partial cross section of a schematic view of a consumable electrode, vacuum arc melting apparatus including an embodiment of the invention.

Referring to the drawings, and for the present to FIG. 1, there is shown a mold 10, which is preferably of copper construction with provision for water cooling (not shown). The mold 10 has an outlet port 12 for connection to a vacuum pump (not shown) for evacuating the mold interior. A magnetic coil 14 is provided on the exterior of the mold to provide a magnetic field to control the configuration and direction of the arc produced during melting and to provide a stirring action to the molten metal prior to solidification thereof in the mold. An electrode assembly 16 is provided within the mold. This apparatus is of conventional and well-known construction. The assembly 16 includes an electrode holder 18 connected to a source of electrical potential (not shown) and to means (not shown) for raising and lowering an associated electrode 20 incident to the melting thereof. An elongated ring 22 is connected at opposite ends to the electrode holder 18 and the electrode 20. The outside diameter of the ring 22 is less than the diameter of the electrode 20 to provide an annular marginal area 24 between the ring 22 and the periphery of the electrode. The copper mold 10 is also connected to a source of electrical potential (not shown).

In accordance with conventional practice, current is supplied through the electrode and mold to result in an arc 26 from the end of the electrode to cause metal 28 to be melted from the electrode to form a molten pool 30 of the metal within the mold 10. The liquid metal 30 progressively solidifies to form a solidified ingot 32.

Figure 2:
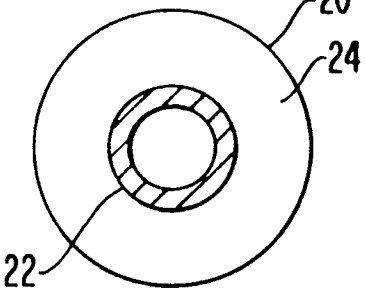
FIG. 2 is a plan view of a portion of the apparatus of FIG. 1.
Figure 3:
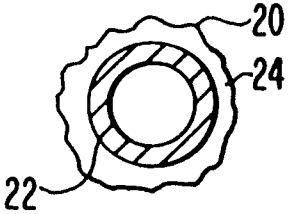
FIG. 3 is a plan view similar to FIG. 2 showing the condition of the electrode at the end of melting.
Figure 4:
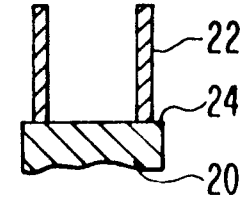
FIG. 4 is a view in vertical cross section of the electrode and associated elongated ring near the end of melting.
Figure 5:
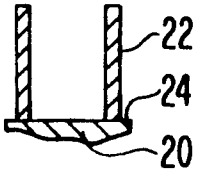
FIG. 5 is a view similar to FIG. 4 showing the electrode at the end of melting.

Prior to the end of melting the ring 22 and electrode 20 are as shown in FIG. 2 with the annular marginal portion 24 being unmelted and of the configuration shown in FIG. 2. Near the completion of melting, the center portion of the electrode 20 melts inwardly, as shown in FIG. 4. As melting is completed the marginal portion 24 begins to melt away, as shown in FIGS. 3 and 5. Consequently, the configuration of the marginal area 24 may be observed as changing from that shown in FIG. 2 with this marginal area in the unmelted state, to the configuration shown in FIG. 3, with this marginal portion 24 being partially melted. This visual indication provides the operator with a notification that the end of melting has been achieved and that the melting operation should be discontinued to prevent melting of the ring and electrode holder to contaminate the ingot 32.

In accordance with this practice of the invention, only a relatively small portion or wafer of the ingot remains in the unmelted condition, which adds considerably to the overall melting efficiency. In this regard, the invention finds particular advantage in the production of titanium and titanium-base alloys.

The monitoring of the condition of the marginal portion 24 of the ingot may be achieved visually through the use of ports provided in the mold or television cameras.

What is claimed is:

1. A method for consumable electrode arc melting of metals and alloys, said method comprising forming an assembly comprising an electrode of the metal or alloy to be melted, an elongated ring having one end connected to one end surface of said electrode, said ring having an outside diameter less than an outside diameter of said electrode to form annular marginal area on said end surface of said electrode defined by said ring and periphery of said end surface, and another end of said elongated ring connected to an electrode holder connected to a source of electrical potential, positioning said assembly within a cooled mold of conductive material connected to a source of electrical potential, producing electrical current between said electrode and said mold to produce an arc from another end surface of said electrode to continuously melt said metal or alloy from said electrode and into said mold for progressive solidification to form an ingot therein while evacuating said mold, continuing said melting until said annular marginal area at least begins to melt and discontinuing said melting before said marginal area melts completely away and absent any melting of the elongated ring, whereby contamination of said ingot by melting of material from said ring or electrode holder into said ingot is avoided.

2. The method of claim 1 wherein said annular marginal area on said end surface of said electrode has a width of at least four inches.

3. The method of claim 2 wherein said one end surface of said electrode has a diameter within the range of 23 to 29 inches.

* * * * *